United States Patent [19]

Whitehouse

[11] Patent Number: 4,470,779

[45] Date of Patent: Sep. 11, 1984

[54] ROTARY FLUID MACHINE WITH EXPANDABLE ROTARY OBTURATOR

[76] Inventor: Ronald C. N. Whitehouse, 34c Netherhall Gardens, London, N.W.3, England

[21] Appl. No.: 482,378

[22] Filed: Apr. 5, 1983

Related U.S. Application Data

[63] Continuation of Ser. No. 160,761, Jun. 18, 1980, abandoned.

[30] Foreign Application Priority Data

| | | | |
|---|---|---|---|
| Jun. 22, 1979 | [GB] | United Kingdom | 7921762 |
| Jul. 13, 1979 | [GB] | United Kingdom | 7924448 |
| Mar. 7, 1980 | [GB] | United Kingdom | 8007743 |

[51] Int. Cl.[3] ..... F01C 1/12; F01C 19/08; F16J 15/16

[52] U.S. Cl. ..... 418/111; 418/196

[58] Field of Search ..... 418/110, 111, 141, 196

[56] References Cited

U.S. PATENT DOCUMENTS

| | | | |
|---|---|---|---|
| 722,480 | 3/1903 | Bergmann | 418/110 |
| 1,020,842 | 3/1912 | Ogden | 418/110 |
| 1,466,904 | 9/1923 | Jackson | 418/111 |
| 1,769,822 | 7/1930 | Blackman | 418/110 |
| 2,958,312 | 11/1960 | Shimomura | 418/111 |
| 3,960,116 | 6/1976 | Ingham | 418/111 |

FOREIGN PATENT DOCUMENTS

| | | | |
|---|---|---|---|
| 753772 | 8/1956 | United Kingdom | 418/141 |

*Primary Examiner*—John J. Vrablik
*Attorney, Agent, or Firm*—Edwin E. Greigg

[57] ABSTRACT

This invention relates to a rotary fluid machine that is actuated by any fluid under pressure in which a rotor carrying a piston member (16) rotates continuously when the machine is in operation about the axis of an annular chamber (14), the piston member is mechanically connected to a rotary obturator ($18_1$, $18_2$) that rotates in a sealing chamber ($15_1$, $15_2$) about an axis substantially parallel to said axis of the annular chamber (14) and the rotary obturator ($18_1$, $18_2$) has a recess ($20_1$, $20_2$) in which a part of the piston enters during rotation, to provide a working section in the annular chamber (14) as working fluid is fed to the piston, the machine is characterized by a rotary obturator ($18_1$, $18_2$) having a body in the form of a solid of revolution that is in at least two parts (FIG. 4) that are able to move along the axis (XX1) of revolution continuously to allow at least a part of the exterior surface of the obturator to be kept in sealing contact with the interior surface of its sealing chamber and/or the annular chamber.

3 Claims, 13 Drawing Figures

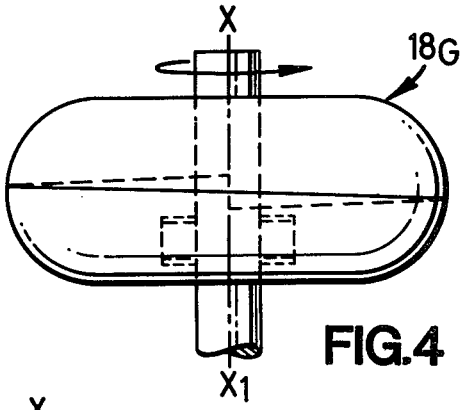
FIG.4
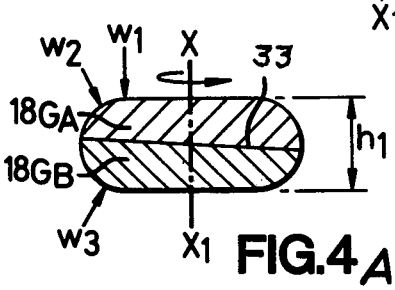
FIG.4A1
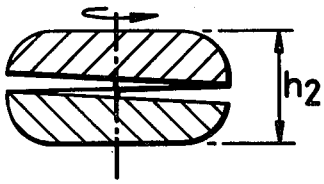
FIG.4A2
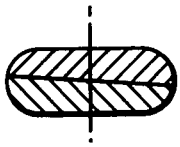
FIG.4B1
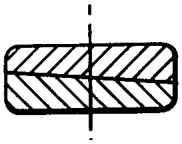
FIG.4B2
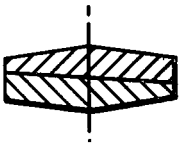
FIG.4B3
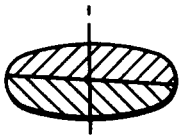
FIG.4B4
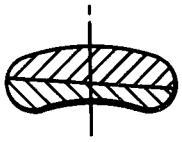
FIG.4B5
FIG.4C
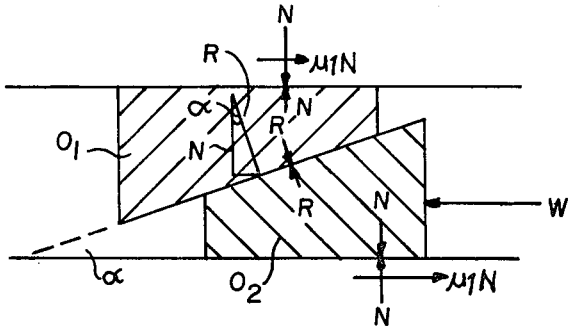

FIG. 5A
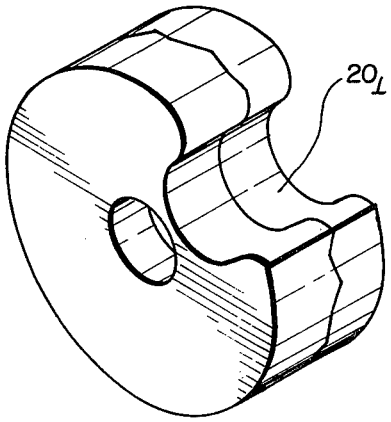
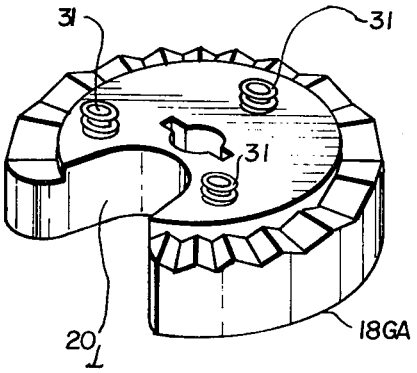
FIG. 5C
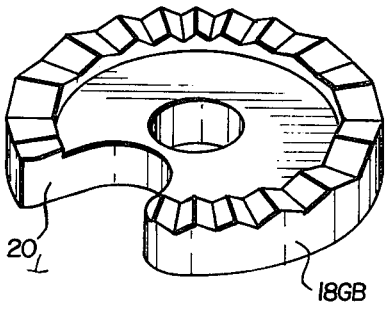
FIG. 5B

ROTARY FLUID MACHINE WITH EXPANDABLE ROTARY OBTURATOR

This is a continuation of application Ser. No. 160,761, filed June 18, 1980, abandoned.

DESCRIPTION

This invention relates to a rotary fluid machine of the kind (hereinafter referred to as the kind set forth) that is to be actuated by fluid acting upon a rotor carrying a piston member that rotates continuously in an annular chamber about the axis of said annular chamber when the machine is in operation about the axis of said annular chamber, the piston member is mechanically connected to a rotary obturator that rotates in a sealing chamber about an axis substantially parallel to said axis of the said annular chamber and the rotary obturator has a recess into which a part of the piston enters during rotation, to provide a working section in the annular chamber as working fluid is fed to the piston.

The term fluid machine is to have a wide meaning to embrace inter alia an engine, a pump, a compressor or a brake in which work is done.

Such rotary fluid machines are known for example from United Kingdom Patent Specifications No. 365,520 and No. 407,661 to Société Les Turbo-Moteurs Guy and from U.S. Pat. No. 3,354,871 to Skrob. It has proved exceptionally difficult to seal to the rotor obturator and without effective sealing the machine is inefficient and this difficulty is fully explained by Skrob.

According to the present invention I provide a rotary fluid machine of the kind set forth wherein the rotary obturator is a body having the form of a solid of revolution that is in at least two parts that are able to move along the axis of revolution continuously to expand the plane figure of the said solid of revolution thereby to allow at least a part of the exterior surface of the obturator to be kept in sealing contact with the interior surface of its sealing chamber and/or the annular chamber.

In one convenient construction the movement may be effected by inclined surfaces which may have a zigzag, serrated or tooth-like form having flat sides on the inclined planes or angles and the parts urged along the said axis by internal rotary helical springs. The essential feature of the rotary obturator is its ability to make rubbing sealing contact with its resident sealing chamber and the annular chamber. The material from which it is fabricated is important. I prefer to use a self-lubricating material such as a carbon or graphitic composition, known under the Trade Name of Morganite special engineering carbons of numerous grades, that co-operates well with an alloy such as a Meehanite metal of which the main casting that houses the obturator may be made. The shape of the movable rotary obturator may be that of a solid of revolution having for its diametral section a substantially rectangular, kidney shape, oval shape or that of a truncated part-triangular figure.

The invention will be more fully understood from the following description given by way of example only with reference to the several figures of the accompanying drawings in which:

FIG. 4 is a side elevation to an enlarged scale of a rotary obturator with insert drawings $4A_1$, $4A_2$ showing its diametral section to a reduced scale and its change in shape with wear as its two parts are continuously urged along the axis.

FIGS. $4B_1$ to $4B_5$ are schematics of various forms of movable obturator shown as a diametral section of a solid of revolution.

In FIG. 4C there is shown a diagram of the forces extant in a two part rotary obturator movable by a helical surface.

FIGS. 5*a, b,* and *c* illustrate a serrated obturator illustrating the half sections.

Figure 1:
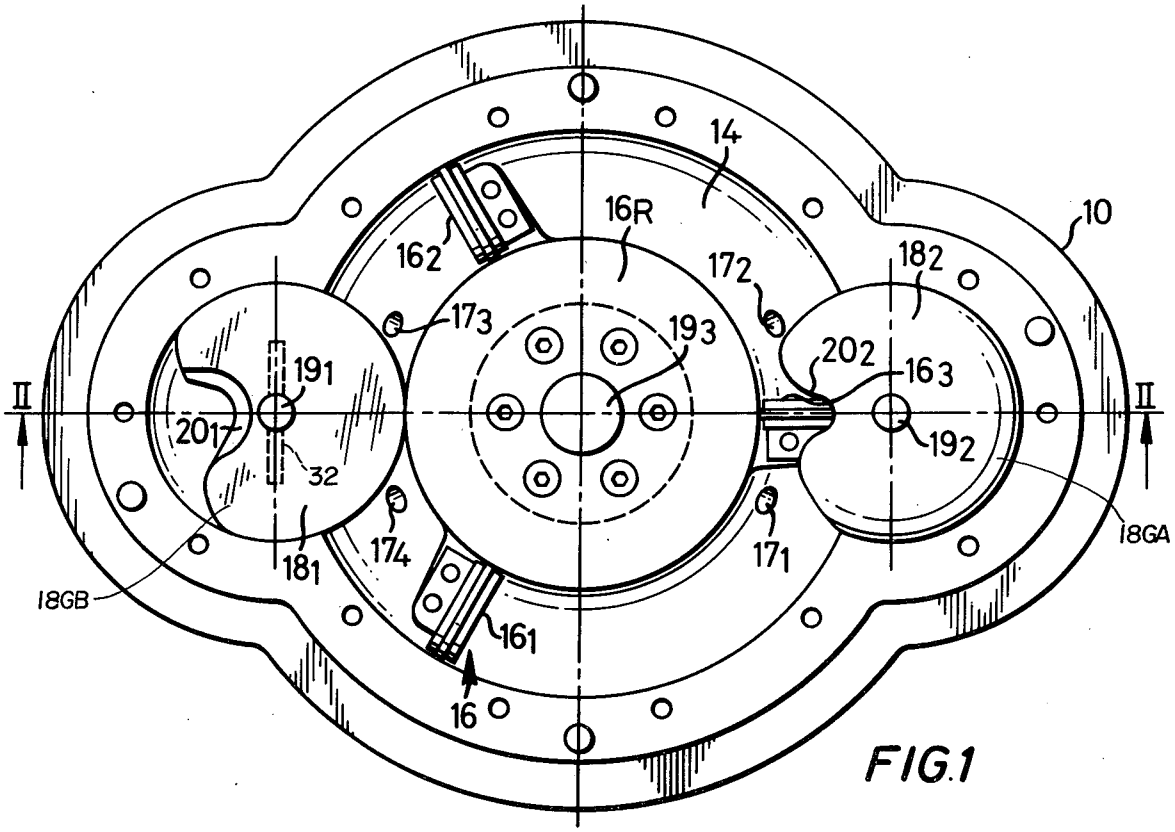
FIG. 1 is a plan view of a rotary machine of the invention with its top facing sealing plate or head removed to show the disposition of parts.
Figure 2:
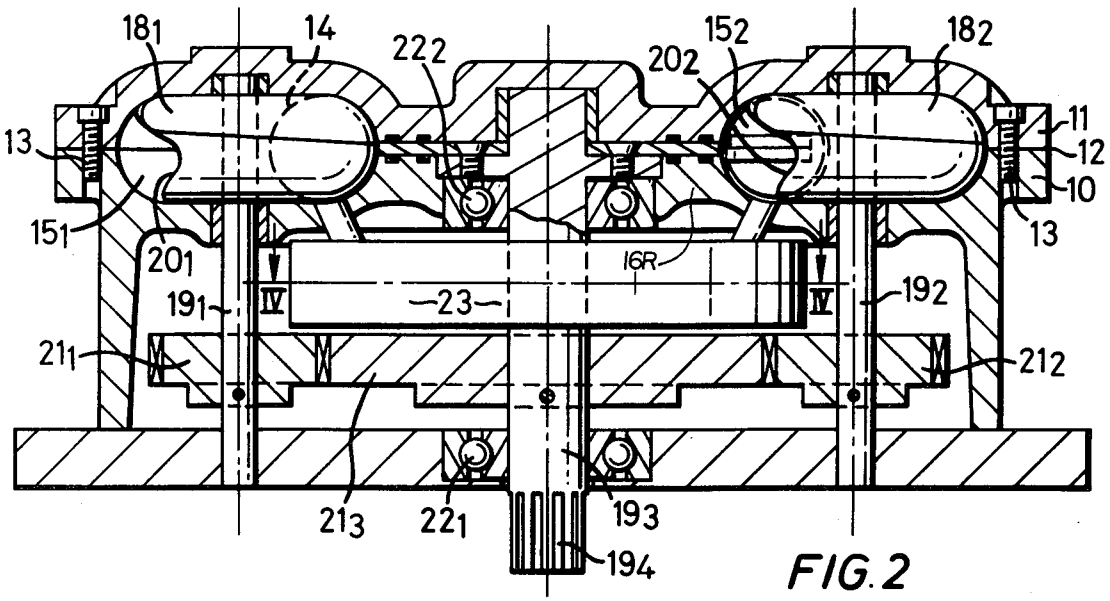
FIG. 2 is a side sectional elevation of the machine of FIG. 1 taken on the diametral section station II II of FIG. 1 with the head in position.

In FIGS. 1 and 2 there is shown a rotary fluid machine comprising a main block 10 and head 11 held into facing contact along the plane surface 12 by bolts 13. An internal annular chamber 14 and two sealing chambers $15_1$, $15_2$ each of a toroidal form are contained within the block and head, and the equatorial plane of each chamber coincides with the plane surface 12.

The larger toroidal chamber 14 is the annular chamber that contains a tripartite piston assembly shown generally at 16 comprising a rotor $16_R$ fitted with equally spaced pistons fitted with rings. The pistons are mounted on the edge of the rotor 16 with their faces normal to the plane of the disc such that any pressure applied to the working faces $16_1$, $16_2$, $16_3$ results in a rotary movement of the piston-rotor assembly. Suitable fluid ports $17_1$, $17_2$, $17_3$, $17_4$ form inlet and outlet ports with an inlet and outlet port on each side of obturators $18_1$ and $18_2$. The smaller toroidal chambers $15_1$, $15_2$ are cut-off or sealing chambers on each side of the chamber 14 spaced at 180° and each contains a rotary obturator $18_1$, $18_2$ journal mounted by means of shafts $19_1$, $19_2$. Each obturator is provided with a piston recess $20_1$, $20_2$ and rotate in the same plane as the rotor $16_R$ to produce a sealed obstruction to operative gases that drive the rotor. There is a three to one gearing ratio between the rotor and the obturators which allow the piston movement to coincide with the cut-out in the obturator. At the left hand side the obturator has its top part removed to show the helical internal surface and mode of fixing to the rotary shaft, at the right hand side of FIG. 1 the obturator has its top part 18GA in position which part is free of the shaft and made to move along the axis of rotation as explained below. The lower part 18GB is keyed to the shaft 19 by key 32. The recesses co-operate with the piston working faces $16_1$, $16_2$, $16_3$ by means of meshing spur gears $21_1$, $21_2$, $21_3$ (FIG. 2) of which $21_1$, $21_2$ are fixed to shafts $19_1$, $19_2$ and $21_3$ to main piston rotor shaft $19_3$ which shaft is the power output shaft and is suitably splined at $19_4$ and journalled in bearing $21_1$, $22_2$. Working fluid is fed to the annular chamber 14 by a metering unit (FIGS. 3A, 3B) shown generally at 23 in FIG. 2.

The metering unit (FIGS. 3A, 3B) comprises four ports $24_1$, $24_2$, $24_3$, $24_4$ an adjustable geared member 25 adjustable by and lockable by meshing gear means 26, an inner divider 27 and an internal passaged member 28 frusto-conically sealed (as shown) and keyed at 29 to main shaft $19_3$, the whole unit being surrounded by housing 30.

Th : modus operandi of the rotary machine of FIGS. 1 and 2 when used as an engine is as follows:

Steam or other suitable fluid is metered to the ports $17_1$, $17_2$, $17_3$, $17_4$ and passes into the expansion chamber 14 continuously to activate the tripartite piston assembly 16 and drive the output shaft $19_3$.

By virtue of the gears $21_1$, $21_2$, $21_3$ the rotary obturators $18_1$, $18_2$ rotate and their cut piston recesses $20_1$, $20_2$ co-operate cyclically with piston working faces $16_1$, $16_2$, $16_3$ to ensure correct working sections of the annular chamber 14 to produce a power stroke as the steam is fed into and exhausted from the expansion chamber 14 by the metering unit 23. As each piston engages with the rotary obturator the exhaust port allows the steam or other fluid to be exhausted. For example in FIG. 1 when piston $16_1$ has finished its power stroke piston $16_2$ takes up the power as steam or other suitable fluid enters port $17_3$ and steam is exhausted from $17_2$ swept out by piston $16_1$.

Piston $16_2$ now enters the recess of the obturator and piston $16_3$ takes up the power with steam supplied from port $17_1$, and so continuous rotation is supplied to rotor 16R and main shaft $19_3$.

Figure 3A:
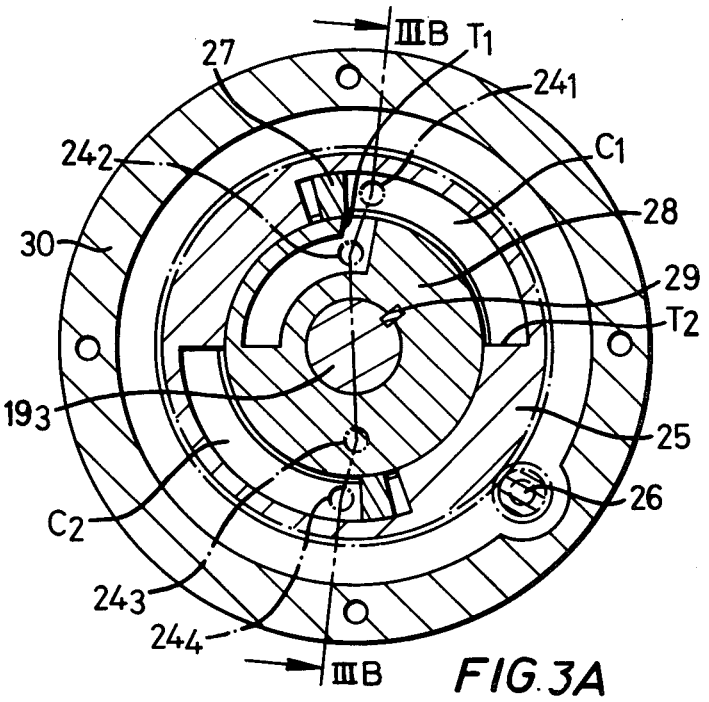
FIG. 3A is a view in orthographic projection of a metering unit in part section for use with the machines of FIGS. 1 and 2.
Figure 3B:
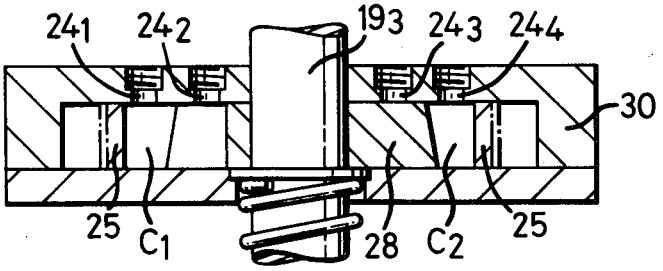
FIG. 3B is a section taken on the section station III-B—IIIB of FIG. 3A.

Let us turn now to the metering unit 23 of FIG. 2 (FIGS. 3A and 3B). When steam or other fluid enters port $17_3$ of the machine it was entered by the unit via inlet $24_2$ and it was at once transferred by compartment $C_1$ to outlet $24_1$. The member 28 having rotated 180 degrees of arc permits steam to now enter port $16_2$ via inlet $24_3$ compartment $C_2$ and $24_4$ to port $17_1$ and so the metering and running action continues mutatis mutandis.

It will be clear that when metering unit member 28 on main shaft $19_3$ is rotated steam is transferred to the working section of the chamber via ports $24_2$, $C_1$, $24_1$ and $17_1$ until the trailing part of transfer port T1 passes the end T2 of compartment $C_1$ acting as a transfer section. Steam is then cut-off from the working section following the Carnot cycle to drive the rotor. For optimum efficiency of working the cut-off position needs to be varied according to the working conditions and this is readily achieved by gear 26 that is able to rotate member 28 and therefore alter the position of T1 and T2.

In the machines the sealing of the rotary obturators $18_1$, $18_2$, is of vital importance to success and to that end as shown in FIGS. 4, $4A_1$, $4A_2$ the rotary obturator generalised at 18G is in two parts and has the well known form of a solid of revolution that is to say one formed by the revolution (rotation) of a plane figure about its axis (XX1). Rotation is a more accurate term for the obturator and its operation in the machine of the invention but solid of revolution is an old geometric and mathematical term in use since c.1816 and whereby retained herein.

In FIG. 4 the rotary obturator is a solid of revolution having the diametral section shown at FIG. $4A_1$. As the obturator rotates wear takes place especially at W1, W2, W3 and the obturator is able to move along the axis XX1 and expand as shown at FIG. 4A by virtue of its internal inclined surfaces, that is, the zig-zags, serrations or tooth-like forms 33. The two parts $18_{GA}$, $18_{GB}$ being spring urged apart by springs 31 to keep continuously in use at least a part of the exterior surface of the two parts in sealing contact with any sealing chamber or part of the annular chamber in which they may be required to operate. As expansion of the plane figure of the obturator takes place and the height of the obturator increases as shown exaggerated by the dimensions $h_1$, $h_2$ in FIGS. $4A_1$, $4A_2$ with this expansion so the swept volume of the obturator is increased also.

The shape of the plane figure of the solid of revolution may take a variety of forms as shown in FIGS. $4B_1$ to $4B_5$. The first of these forms at FIG. $4B_1$ is a figure possessing rotational symmetry having the form of a saucisson. FIG. $4B_2$ possesses rotational symmetry having the form of a rectangle with suitable edge radii. FIG. $4B_3$ possesses rotational symmetry having the form of a quasi-cone. FIG. $4B_4$ possesses rotational symmetry having the form of an oval and $4B_5$ a kidney shape not possessing rotational symmetry.

Let us consider now the self-adjusting expansible nature of the obturator of the general form of 18G FIG. 4.

The two parts have internal inclined interfaces having flat sides on the inclined planes or angles that are either right or left handed that may conveniently be represented by two opposing wedges as shown in FIG. 4C. An applied force W brings about reactions N normal to the inner surface of the sealing chamber that may be for example of Meehanite alloy and a reaction R between the two halves of the obturator $O_1$, $O_2$ that may be for example of a special engineering carbon composite. The coefficient of friction between the surface of the annular chamber and the sealing chamber and the obturator each of different materials is $\mu 1$ and that the coefficient of friction between the same material of the two obturator parts $\mu 2$. The angle of the helix between the two obturator parts is $\alpha$.

The size of the normal force N (and indirectly the wear rate) increases as the angle $\alpha$ decreases.

Clearly the obturator may have for example an internal part making it a tripartite structure, if the three parts are all of the same material then $\mu 2$ is as stated above. A more complex situation arises if the parts are not all of the same material and other co-efficients of friction enter the equations, yet this may give a more efficacious set of conditions for sealing. The-zig-zag, serrations, or tooth-like forms allow indexing of the parts of the obturator.

I claim:

1. In a rotary fluid machine having a housing and an expandable obturator rotatable within an annular sealing chamber in said housing, shaft means rotatably supporting said obturator for rotation about an axis coaxial with an axis of the sealing chamber which latter axis is fixed in said housing, said obturator comprising a body having the form of a solid of revolution having at least two parts having axially abutting serrated surfaces comprising flat sided inclined planes, interlocking means coupling one of said parts on shaft means against rotation relative to the latter, the other of said parts being freely rotatable on said shaft and axially movable thereon, said obturator parts having a coefficient of friction between said abutting surfaces that is less than the coefficient of friction between the exterior surfaces of said parts and complementary interior surfaces of said sealing chamber, whereby as the obturator is rotated the higher frictional engagement of the exterior surface of its freely rotatable part with the coacting surface of the sealing chamber causes said rotatable part to be rotationally urged relative to said abutting part and the inclines to coact to axially expand the obturator to maintain sealing contact with a complementary interior surface of the sealing chamber.

2. A rotary fluid machine including a housing and an expandable obturator rotatable within an annular sealing chamber in said housing, said obturator being journalled on a shaft rotatable about a fixed axis in said housing which is coaxial with the axis of said sealing chamber, said obturator having the form of a solid of revolution having two sections having axially abutting surfaces, at least one of said sections being axially slidable and freely rotatable relative to the other on said shaft continuously to axially expand said obturator thereby to allow at least a portion of the exterior surface of said obturator to be kept in sealing contact with a complementarily shaped interior of said sealing chamber, said obturator section being axially based in obturator expanding direction by at least one internal biasing means, the degree of axial movement between the two sections being controlled by coacting double faced flat sided inclines on opposed surfaces of said abutting sections constructed and arranged to permit said axial movement in contrarotating directions of said shaft.

3. A rotary fluid machine according to claim 2 in which the double faced inclines on the obturator sections are located on perimeteral portions of said opposed surfaces.

* * * * *